US009290998B2

(12) United States Patent
Radford

(10) Patent No.: US 9,290,998 B2
(45) Date of Patent: Mar. 22, 2016

(54) ACTUATION MECHANISMS FOR DOWNHOLE ASSEMBLIES AND RELATED DOWNHOLE ASSEMBLIES AND METHODS

(71) Applicant: Baker Hughes Incorporated, Houston, TX (US)

(72) Inventor: Steven R. Radford, The Woodlands, TX (US)

(73) Assignee: Baker Hughes Incorporated, Houston, TX (US)

( * ) Notice: Subject to any disclaimer, the term of this patent is extended or adjusted under 35 U.S.C. 154(b) by 408 days.

(21) Appl. No.: 13/776,343

(22) Filed: Feb. 25, 2013

(65) Prior Publication Data

US 2014/0238746 A1 Aug. 28, 2014

(51) Int. Cl.
*E21B 10/32* (2006.01)

(52) U.S. Cl.
CPC ..... *E21B 10/322* (2013.01)

(58) Field of Classification Search
CPC ..... E21B 10/322; E21B 23/08; E21B 23/04; E21B 2034/007; E21B 34/14
See application file for complete search history.

(56) References Cited

U.S. PATENT DOCUMENTS

| | | | |
|---|---|---|---|
| 1,678,075 | A | 7/1928 | Phipps |
| 2,069,482 | A | 2/1937 | Seay |
| 2,177,721 | A | 10/1939 | Johnson et al. |
| 2,344,598 | A | 3/1944 | Church |
| 2,754,089 | A | 7/1956 | Kammerer, Jr. |
| 2,758,819 | A | 8/1956 | Kammerer, Jr. |
| 2,834,578 | A | 5/1958 | Carr |
| 2,882,019 | A | 4/1959 | Carr et al. |
| 3,105,562 | A | 10/1963 | Stone et al. |
| 3,123,162 | A | 3/1964 | Rowley |
| 3,126,065 | A | 3/1964 | Chadderdon |
| 3,211,232 | A | 10/1965 | Grimmer |

(Continued)

FOREIGN PATENT DOCUMENTS

| | | | |
|---|---|---|---|
| EP | 246789 | A2 | 11/1987 |
| EP | 1036913 | A1 | 9/2000 |

(Continued)

OTHER PUBLICATIONS

Radford et al., U.S. Appl. No. 13/273,373, "Selectively Actuating Expandable Reamers and Related Methods", filed Dec. 15, 2011.

(Continued)

*Primary Examiner* — Jennifer H Gay
(74) *Attorney, Agent, or Firm* — TraskBritt

(57) ABSTRACT

Actuation mechanisms for downhole assemblies in earth-boring applications may comprise a housing comprising an internal bore defining a flow path through the housing. An actuation member may be supported within the housing. A movable sleeve may be located within the internal bore and may be movable between a first position and a second position responsive to changes in flow rate of fluid flowing through the flow path. The movable sleeve may be biased toward the first position. The actuation member may be in an initial, pre-actuation position when the movable sleeve is initially located in the first position. The actuation member may be movable to a subsequent, pre-actuation position when the movable sleeve is located in the second position. The actuation member may be released from the actuation mechanism when the movable sleeve is returned to the first position.

14 Claims, 11 Drawing Sheets

(56) References Cited

U.S. PATENT DOCUMENTS

| | | | | |
|---|---|---|---|---|
| 3,224,507 | A | 12/1965 | Cordary, Jr. | |
| 3,425,500 | A | 2/1969 | Fuchs | |
| 3,433,313 | A | 3/1969 | Brown | |
| 3,556,233 | A | 1/1971 | Gilreath | |
| 4,403,659 | A | 9/1983 | Upchurch | |
| 4,458,761 | A | 7/1984 | Van Vreeswyk | |
| 4,545,441 | A | 10/1985 | Williamson | |
| 4,589,504 | A | 5/1986 | Simpson | |
| 4,660,657 | A | 4/1987 | Furse et al. | |
| 4,690,229 | A | 9/1987 | Raney | |
| 4,693,328 | A | 9/1987 | Furse et al. | |
| 4,842,083 | A | 6/1989 | Raney | |
| 4,848,490 | A | 7/1989 | Anderson | |
| 4,854,403 | A | 8/1989 | Ostertag et al. | |
| 4,884,477 | A | 12/1989 | Smith et al. | |
| 4,889,197 | A | 12/1989 | Boe | |
| 4,893,678 | A * | 1/1990 | Stokley et al. | 166/374 |
| 5,139,098 | A | 8/1992 | Blake | |
| 5,211,241 | A | 5/1993 | Mashaw et al. | |
| 5,224,558 | A | 7/1993 | Lee | |
| 5,265,684 | A | 11/1993 | Rosenhauch | |
| 5,293,945 | A | 3/1994 | Rosenhauch et al. | |
| 5,305,833 | A | 4/1994 | Collins | |
| 5,318,131 | A | 6/1994 | Baker | |
| 5,318,137 | A | 6/1994 | Johnson et al. | |
| 5,318,138 | A | 6/1994 | Dewey et al. | |
| 5,332,048 | A | 7/1994 | Underwood et al. | |
| 5,343,963 | A | 9/1994 | Bouldin et al. | |
| 5,361,859 | A | 11/1994 | Tibbitts | |
| 5,368,114 | A | 11/1994 | Tandberg et al. | |
| 5,375,662 | A | 12/1994 | Echols, III et al. | |
| 5,425,423 | A | 6/1995 | Dobson et al. | |
| 5,437,308 | A | 8/1995 | Morin et al. | |
| 5,553,678 | A | 9/1996 | Barr et al. | |
| 5,560,440 | A | 10/1996 | Tibbitts | |
| 5,740,864 | A | 4/1998 | de Hoedt et al. | |
| 5,788,000 | A | 8/1998 | Maury et al. | |
| 5,823,254 | A | 10/1998 | Dobson et al. | |
| 5,887,655 | A | 3/1999 | Haugen et al. | |
| 6,039,131 | A | 3/2000 | Beaton | |
| 6,059,051 | A | 5/2000 | Jewkes et al. | |
| 6,109,354 | A | 8/2000 | Ringgenberg et al. | |
| 6,116,336 | A | 9/2000 | Adkins et al. | |
| 6,131,675 | A | 10/2000 | Anderson | |
| 6,189,631 | B1 | 2/2001 | Sheshtawy | |
| 6,213,226 | B1 | 4/2001 | Eppink et al. | |
| 6,227,312 | B1 | 5/2001 | Eppink et al. | |
| 6,289,999 | B1 | 9/2001 | Dewey et al. | |
| 6,325,151 | B1 | 12/2001 | Vincent et al. | |
| 6,378,632 | B1 | 4/2002 | Dewey | |
| 6,488,104 | B1 | 12/2002 | Eppink et al. | |
| 6,494,272 | B1 | 12/2002 | Eppink et al. | |
| 6,615,933 | B1 | 9/2003 | Eddison | |
| 6,668,949 | B1 | 12/2003 | Rives | |
| 6,708,785 | B1 | 3/2004 | Russell et al. | |
| 6,732,817 | B2 | 5/2004 | Dewey et al. | |
| 6,959,766 | B2 | 11/2005 | Connell | |
| 7,021,389 | B2 * | 4/2006 | Bishop et al. | 166/373 |
| 7,048,078 | B2 | 5/2006 | Dewey et al. | |
| 7,314,099 | B2 | 1/2008 | Dewey et al. | |
| 7,513,318 | B2 | 4/2009 | Underwood et al. | |
| 7,624,810 | B2 | 12/2009 | Fould et al. | |
| 8,356,671 | B2 * | 1/2013 | Guillory et al. | 166/318 |
| 8,701,776 | B2 * | 4/2014 | Smith et al. | 166/318 |
| 8,783,365 | B2 * | 7/2014 | McCoy et al. | 166/373 |
| 8,863,853 | B1 * | 10/2014 | Harris et al. | 166/386 |
| 9,010,447 | B2 * | 4/2015 | Themig et al. | 166/386 |
| 2002/0070052 | A1 | 6/2002 | Armell | |
| 2003/0029644 | A1 | 2/2003 | Hoffmaster et al. | |
| 2004/0163820 | A1 * | 8/2004 | Bishop et al. | 166/373 |
| 2009/0056934 | A1 * | 3/2009 | Xu | 166/244.1 |
| 2010/0089583 | A1 * | 4/2010 | Xu et al. | 166/298 |
| 2010/0132954 | A1 * | 6/2010 | Telfer | 166/373 |
| 2011/0073376 | A1 * | 3/2011 | Radford et al. | 175/269 |
| 2011/0278017 | A1 * | 11/2011 | Themig et al. | 166/373 |
| 2011/0284233 | A1 | 11/2011 | Wu et al. | |
| 2011/0315389 | A1 * | 12/2011 | Crider et al. | 166/329 |
| 2011/0315390 | A1 * | 12/2011 | Guillory et al. | 166/329 |
| 2012/0227973 | A1 * | 9/2012 | Hart et al. | 166/329 |
| 2012/0261131 | A1 * | 10/2012 | Hofman et al. | 166/316 |
| 2013/0025868 | A1 * | 1/2013 | Smith et al. | 166/308.1 |
| 2013/0025876 | A1 * | 1/2013 | McCoy et al. | 166/373 |
| 2013/0068475 | A1 * | 3/2013 | Hofman et al. | 166/373 |
| 2014/0238746 | A1 * | 8/2014 | Radford | 175/57 |
| 2015/0000920 | A1 * | 1/2015 | Harris et al. | 166/308.1 |
| 2015/0159469 | A1 * | 6/2015 | Purkis et al. | E21B 34/16 |
| 2015/0167428 | A1 * | 6/2015 | Hofman et al. | E21B 34/16 |

FOREIGN PATENT DOCUMENTS

| | | | |
|---|---|---|---|
| EP | 1044314 | A1 | 3/2005 |
| GB | 2328964 | A | 3/1999 |
| GB | 2344607 | A | 6/2000 |
| GB | 2344122 | B | 4/2003 |
| WO | 0031371 | A1 | 6/2000 |

OTHER PUBLICATIONS

Radford et al., U.S. Appl. No. 61/619,869, "Expandable Reamers and Methods of Using Expandable Reamers", filed Apr. 3, 2012.

* cited by examiner

ACTUATION MECHANISMS FOR DOWNHOLE ASSEMBLIES AND RELATED DOWNHOLE ASSEMBLIES AND METHODS

FIELD

The disclosure relates generally to downhole assemblies for use in earth-boring applications. More specifically, disclosed embodiments relate to actuation mechanisms for downhole assemblies that may enable actuation to occur while fluids flow at a low flow rate through the downhole assemblies, which may reduce (e.g., eliminate) the likelihood that actuation will damage components of the downhole assemblies.

BACKGROUND

Some earth-boring tools are configured to selectively actuate to enable the earth-boring tools to engage with an earth formation. For example, an expandable reamer may be attached to a drill string, tripped down a borehole, and actuated within the borehole to extend blades of the expandable reamer and engage with a sidewall defining the borehole. As another example, a coring bit may be attached to a drill string, tripped down a borehole, have fluid pumped through a central bore of the coring bit at a high flow rate to remove any detritus collected at the bottom of the borehole, and be actuated to redirect flow from the central bore to peripheral nozzles and clear the central bore for receipt of a core sample.

In some applications, actuation may be accomplished by dropping an actuation member (e.g., a ball) at an upper end of the drill string into a central bore of the drill string to travel down the drill string (e.g., in response to drilling fluid flowing down the central bore or under the influence of gravity) and actuate the earth-boring tool by engaging with an actuating receptacle (e.g., a ball seat or collet). In other applications, dropping the actuation member at the upper end of the drill string may not be feasible because of components in the drill string between the upper end and the actuating receptacle that may interfere with (e.g., prevent) the actuation member's travel down the drill string. For example, measuring-while-drilling instrumentation frequently relies on pulse telemetry to communicate information measured in the borehole back to the surface, which may involve placing a valve in the flow path down the central bore. The valve may open and shut frequently to create the pulses that convey information to a receiver at the surface, which valve may render passing any actuation member through the measuring-while-drilling apparatus in the drill string unfeasible. As another example, downhole motors may be used to rotate earth-boring tools, instead of using a motor at the surface to rotate the entire drill string. Rotors within downhole motors may be driven by fluid pumped down the central bore of the drill string and may block or even destroy any actuation members attempting to pass through the downhole motors.

To enable actuation of selectively actuating earth-boring tools having such interfering components located above them in the drill string, downhole actuation mechanisms have been proposed. For example, U.S. Pat. No. 6,959,766, issued Nov. 1, 2005, to Connell, the disclosure of which is incorporated herein in its entirety by this reference, discloses a downhole ball drop tool actuated by dropping a small, releasing ball down the drill string, which small, releasing ball may have a small outer diameter and pass through tools or mechanisms that have restrictive flow paths. The releasing ball engages with a seat, building pressure of the drilling fluid until the seat and its associated sleeve move down and rotate rocker arms that are positioned to rotate and release an actuating ball. As another example, U.S. Pat. No. 7,624,810, issued Dec. 1, 2009, to Fould et al., the disclosure of which is incorporated herein in its entirety by this reference, discloses a ball dropping assembly for use in a well. A piston in a pocket of a ball dropping sub shears a shear pin when fluid flowing down the drill string exerts sufficient force and extends into the flow path to deploy the ball.

BRIEF SUMMARY

In some embodiments, downhole assemblies for earth-boring applications may comprise a selectively actuatable earth-boring tool and an actuation mechanism located above the selectively actuatable earth-boring tool in the downhole assembly. The actuation mechanism may comprise a housing comprising an internal bore defining a flow path through the housing. An actuation member may be supported within the housing and may be sized and configured to selectively actuate the selectively actuatable earth-boring tool. A movable sleeve may be located within the internal bore and may be movable between a first position and a second position responsive to changes in flow rate of fluid flowing through the flow path. The movable sleeve may be biased toward the first position. The actuation member may be in an initial, pre-actuation position when the movable sleeve is initially located in the first position. The actuation member may be movable to a subsequent, pre-actuation position when the movable sleeve is located in the second position. The actuation member may be released from the actuation mechanism when the movable sleeve is returned to the first position.

In other embodiments, actuation mechanisms for downhole assemblies in earth-boring applications may comprise a housing comprising an internal bore defining a flow path through the housing. An actuation member may be sized and configured to be supported within the housing. A movable sleeve may be located within the internal bore and may be movable between a first position and a second position responsive to changes in flow rate of fluid flowing through the flow path. The movable sleeve may be biased toward the first position. The actuation member may be in an initial, pre-actuation position when the movable sleeve is initially located in the first position. The actuation member may be movable to a subsequent, pre-actuation position when the movable sleeve is located in the second position. The actuation member may be released from the actuation mechanism when the movable sleeve is returned to the first position.

In still other embodiments, methods of using actuation mechanisms for downhole assemblies in earth-boring applications may comprise increasing flow rate of a fluid flowing through a flow path defined by an internal bore of a housing. A movable sleeve biased toward a first position may be moved from the first position to a second position responsive to the increase in flow rate. An actuation member may be released to move from an initial, pre-actuation position to a subsequent, pre-actuation position responsive to the movable sleeve being located in the second position. Flow rate of the fluid flowing through the flow path may be reduced. The movable sleeve may be returned to the first position responsive to the decrease in flow rate. The actuation member may be released from the actuation mechanism.

BRIEF DESCRIPTION OF THE DRAWINGS

While the disclosure concludes with claims particularly pointing out and distinctly claiming embodiments encompassed by the disclosure, various features and advantages of embodiments within the scope of the disclosure may be more readily ascertained from the following description when read in conjunction with the accompanying drawings, in which:

DETAILED DESCRIPTION

The illustrations presented herein are not meant to be actual views of any particular downhole assembly, actuation mechanism, or component thereof, but are merely idealized representations employed to describe illustrative embodiments. Thus, the drawings are not necessarily to scale.

Disclosed embodiments relate generally to actuation mechanisms for downhole assemblies that may enable actuation to occur while fluids flow at a low flow rate through the downhole assemblies, which may reduce (e.g., eliminate) the likelihood that actuation will damage components of the downhole assemblies. More specifically, disclosed are embodiments of actuation mechanisms that may release an actuating member to travel down a drill string in response to an increase and subsequent decrease in flow rate of fluid flowing through the drill string.

As used herein, the term "drilling fluid" means and includes any fluid that may be directed down a drill string during drilling of a subterranean formation. For example, drilling fluids include liquids, gases, combinations of liquids and gases, fluids with solids in suspension with the fluids, oil-based fluids, water-based fluids, air-based fluids, and muds.

As used herein, the term "selectively actuatable earth-boring tool" means and includes any tool configured to engage with an earth formation and to transition between a pre-actuation state and an actuated state responsive to an actuating member engaging with an actuation receptacle. For example, selectively actuatable earth-boring tools include expandable reamers, expandable stabilizers, expandable earth-boring drill bits, and core barrels and coring bits.

Figure 1:
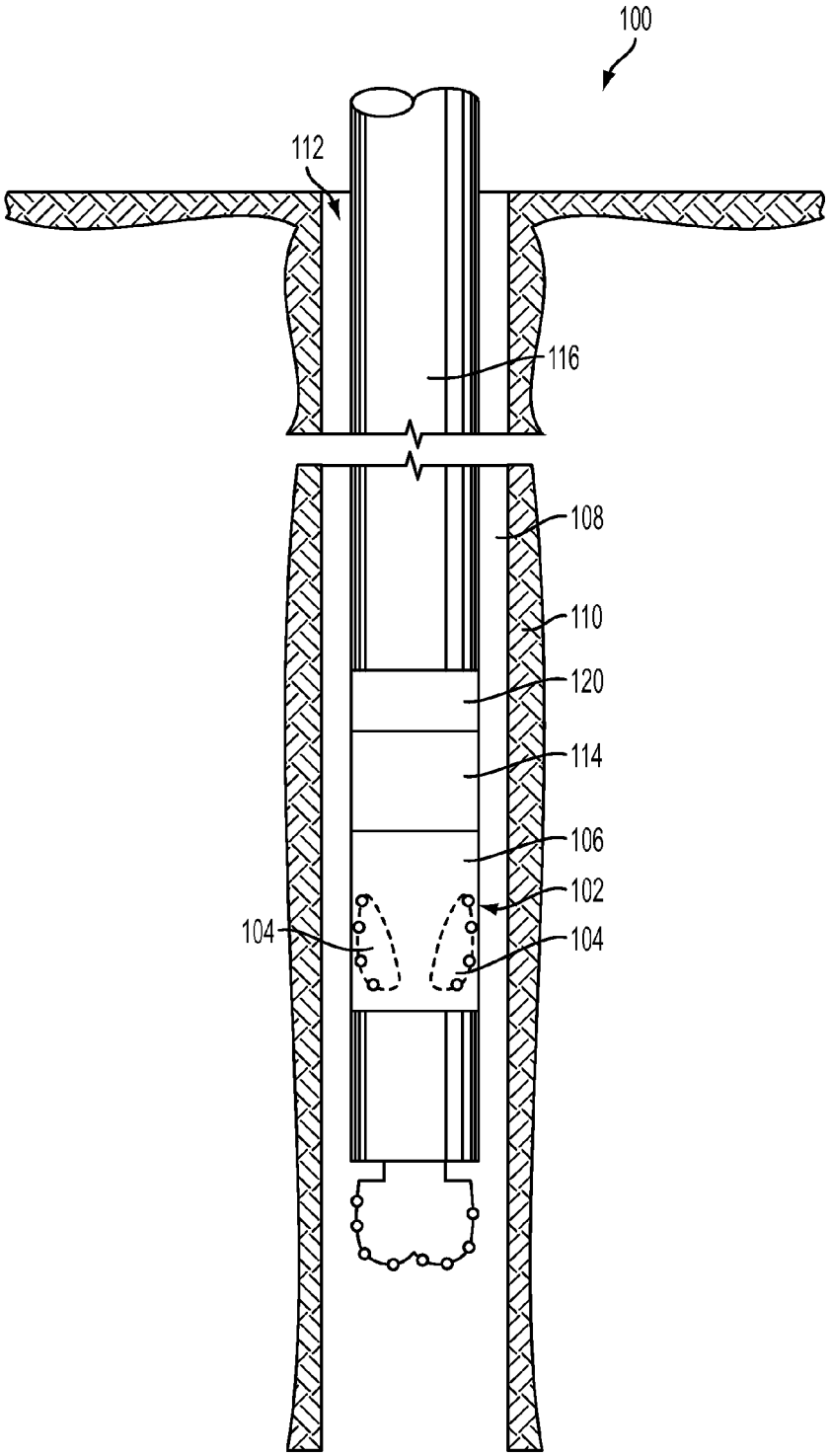
FIG. 1 is a schematic view of a downhole assembly with a selectively actuatable earth-boring tool in a first state.

Referring to FIG. 1, a schematic view of a downhole assembly 100 with a selectively actuatable earth-boring tool 102 in a first, pre-actuation state is shown. The selectively actuatable earth-boring tool 102 in the shown embodiment may comprise an expandable reamer or an expandable stabilizer, though selectively actuatable earth-boring tools may comprise, for example, expandable earth-boring drill bits, core barrels and coring bits, or other earth-boring tools configured to transition between a pre-actuation state and an actuated state responsive to an actuating member engaging with an actuation receptacle in other embodiments. The selectively actuatable earth-boring tool 102 may include, for example, extendable blades 104, which may be retracted when the selectively actuatable earth-boring tool 102 is in the pre-actuation state. More specifically, radially outermost surfaces of the extendable blades 104 may be radially inward from or substantially coincident to a radially outermost surface of a housing 106 of the selectively actuatable earth-boring tool 102 such that the extendable blades 104 do not extend substantially into an annulus 108 defined between the housing 106 of the selectively actuatable earth-boring tool 102 and a wall 110 of a borehole 112 in which the downhole assembly 100 may be located. In some embodiments, blades 104 may carry cutting structures as shown in FIGS. 1 and 2, such as, for example, polycrystalline diamond compact (PDC) cutting elements for removing subterranean formation material, while in other embodiments blades 104 may comprise bearing and wear structures thereon for engaging and riding upon the wall of a wellbore to stabilize a downhole assembly.

The selectively actuatable earth-boring tool 102 may include an actuating receptacle configured to engage with an actuation member 118 (see FIG. 3) to actuate the selectively actuatable earth-boring tool 102. For example, the selectively actuatable earth-boring tool 102 may include, by way of example and not limitation, any of the actuating receptacles disclosed in U.S. patent application Ser. No. 13/327,373, filed Dec. 15, 2011, now U.S. Pat. No. 8,960,333, issued Feb. 24, 2015, for "SELECTIVELY ACTUATING EXPANDABLE REAMERS AND RELATED METHODS," and U.S. Provisional Patent Application Ser. No. 61/619,869, filed Apr. 3, 2012, for "EXPANDABLE REAMERS AND METHODS OF USING EXPANDABLE REAMERS," the disclosure of each of which is incorporated herein in its entirety by this reference. Briefly, the actuation member 118 (see FIG. 3) may travel to the selectively actuatable earth-boring tool 102 and, within a bore of the tool, engage with the actuating receptacle to alter at least one of the flow rate, and resulting pressure, or flow path of fluid (e.g., drilling fluid) flowing through a bore of the selectively actuatable earth-boring tool 102, which alteration may cause corresponding movement (e.g., extension) of the extendable blades 104 through movement of one or more members of the tool acted upon by fluid within the tool bore.

The downhole assembly 100 may also include an actuation mechanism 114 located above the selectively actuatable earth-boring tool 102. In some embodiments, the actuation mechanism 114 may be located adjacent and directly connected to the selectively actuatable earth-boring tool 102. In other embodiments, one or more sections of drill pipe or drill collar 116, or other tubular goods having sufficiently unobstructed bores to enable passage of actuating member 118 may be interposed between and connected to the actuation mechanism 114 and the selectively actuatable earth-boring tool 102. The actuation mechanism 114 may be configured to release an actuation member 118 (see FIG. 3) to engage with an actuating receptacle of the actuatable earth-boring tool 102. The downhole assembly 100 may also include a flow-path obstructing component 120, such as, for example, a measuring-while-drilling apparatus or a downhole motor, located above and connected directly or indirectly to the actuation mechanism 114. In some embodiments, flow-path obstructing component 120 may be located adjacent and directly connected to the actuation mechanism 114. In other embodiments, one or more sections of drill pipe or drill collar 116 or other tubular goods may be interposed between and connected to the flow-path obstructing component 120 and the actuation mechanism 114. The flow path obstructing component 120 may interfere with (e.g., prevent) travel of any actuation member 118 from above the flow path obstructing component 120, through the flow path obstructing component 120, to the selectively actuatable earth-boring tool 102. Thus, the actuation mechanism 114 may be located after the flow path obstructing component 120 in the direction of flow of fluid through the downhole assembly 100 and the selectively actuatable earth-boring tool 102 may be located after the actuation mechanism 114 in the direction of flow of fluid through the downhole assembly 100.

Figure 2:
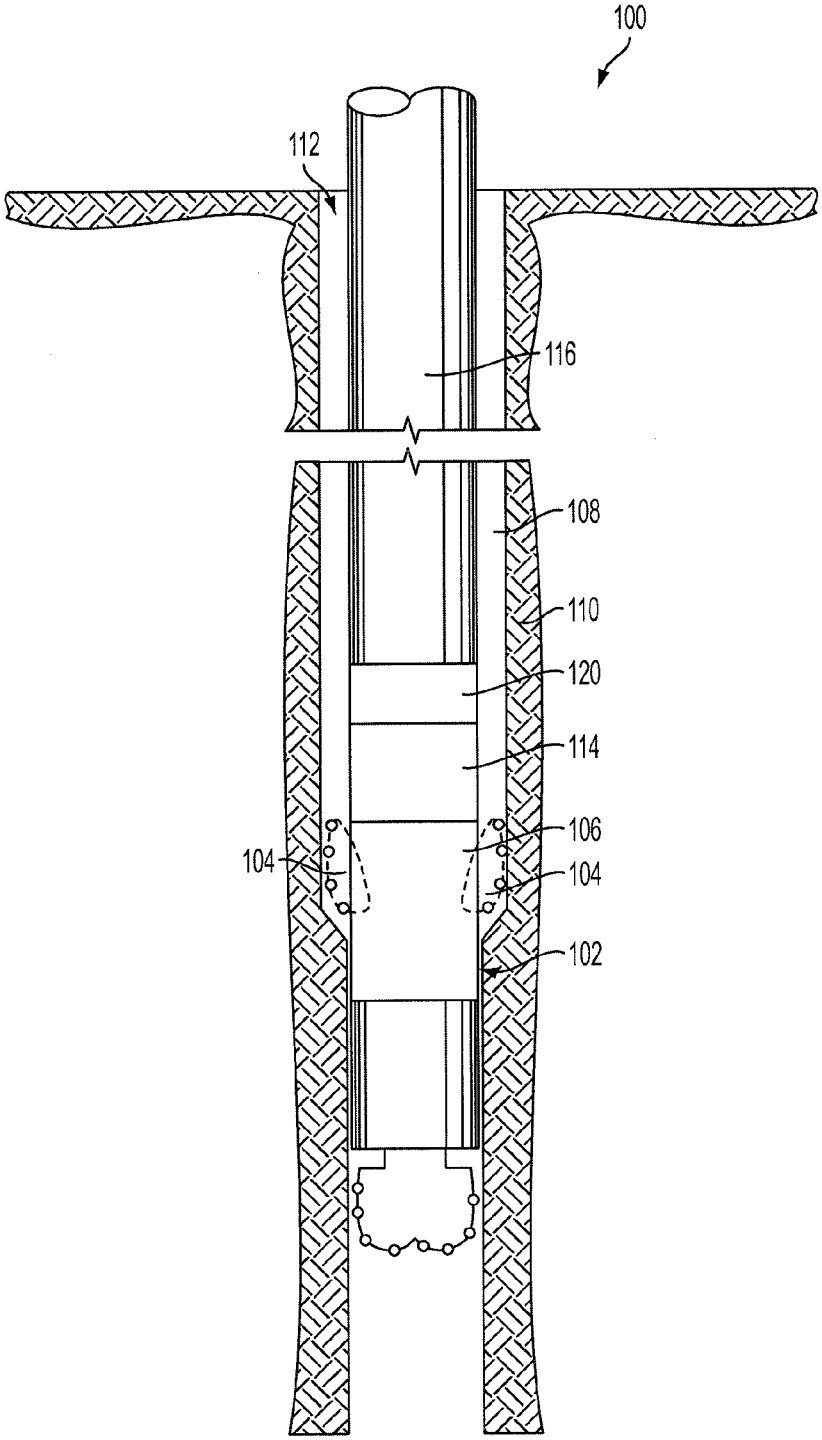
FIG. 2 is a schematic view of the downhole assembly of FIG. 1 with the selectively actuatable earth-boring tool in a second state.

Referring to FIG. 2, a schematic view of the downhole assembly 100 of FIG. 1 with the selectively actuatable earth-boring tool 102 in a second, actuated state is shown. After the actuation member 118 has been released by the actuation mechanism 114 and the actuation member 118 has engaged with an actuating receptacle of the earth-boring tool 102, the selectively actuatable earth-boring tool 102 may transition from its first, pre-actuation state (see FIG. 1) to its second, actuated state. For example, actuating the selectively actuatable earth-boring tool 102 may cause the extendable blades 104 to extend from a retracted position to an extended position. More specifically, the radially outermost surfaces of the extendable blades 104 may extend radially outward from the radially outermost surface of a housing 106 of the selectively actuatable earth-boring tool 102 such that the extendable blades 104 are located in the annulus 108 defined between the housing 106 of the selectively actuatable earth-boring tool 102 and the wall 110 of the borehole 112 in which the downhole assembly 100 may be located. In some embodiments, extending the extendable blades 104 may cause them to contact and penetrate, in the case of an expandable reamer, into the wall 110 of the borehole 112 to remove the material thereof, or ride upon the wall of the wellbore, in the case of an expandable stabilizer, as the selectively actuatable earth-boring tool 102 is rotated.

Figure 3:
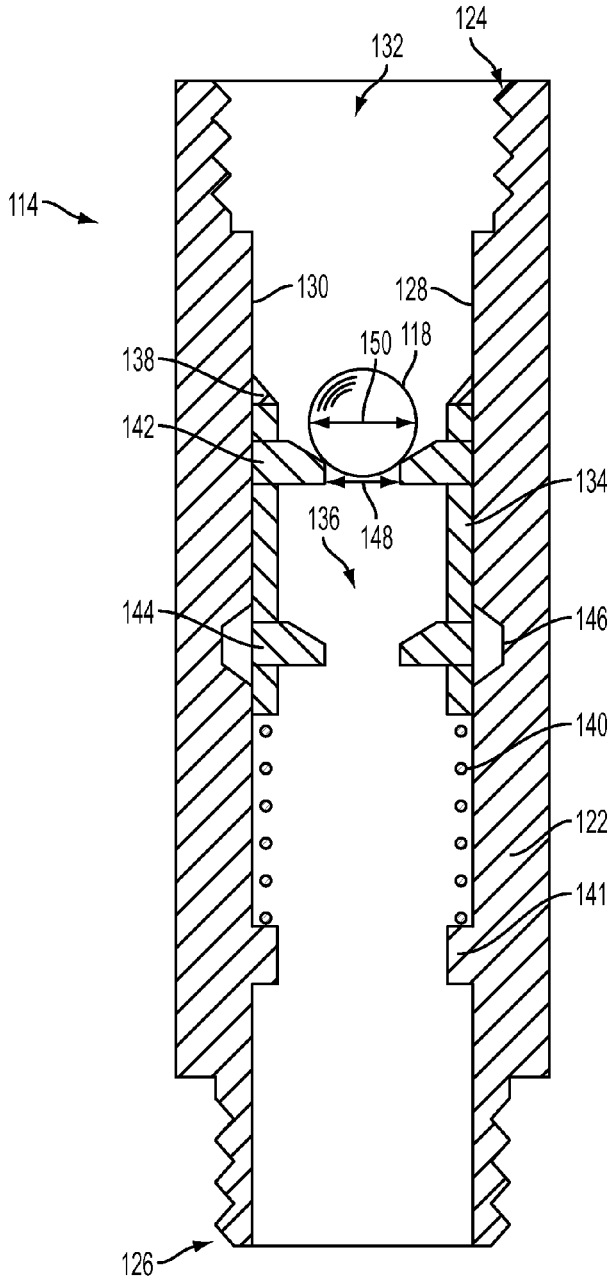
FIG. 3 is a cross-sectional view of an actuation mechanism of the downhole assembly of FIG. 1 in a first state.

Referring to FIG. 3, a cross-sectional view of an actuation mechanism 114 of the downhole assembly of FIG. 1 is shown in a first, initial state. The actuation mechanism 114 may include a housing 122. The housing 122 may define an outer body of the actuation mechanism 114 to contain other components of the actuation mechanism 114. Ends 124 and 126 of the housing 122 may include connection portions (e.g., American Petroleum Institute (API) threaded connections) to connect the housing 122 to other components of a downhole assembly 100 (see FIGS. 1 and 2). The housing 122 may comprise a tubular member having an interior surface 128 defining an internal bore 130 extending from one end 124 to the other end 126 of the housing 122. The internal bore 130 may form a flow path 132 for fluid (e.g., drilling fluid) to flow through the actuation mechanism 114.

The actuation mechanism 114 may include a movable sleeve 134 located in the internal bore 130 and supported within the housing 122. The movable sleeve 134 may comprise a tubular body including a central flow path 136 for fluid to flow through the movable sleeve 134. The movable sleeve 134 may be configured to move between a first position, as shown in FIG. 3, and a second position (see FIG. 4) within the housing 122. In the first position, the movable sleeve 134 may be located, for example, at an uppermost extent of axial travel for the movable sleeve 134 in a direction opposing a direction of flow for fluid in the flow path 132 in some embodiments. More specifically, the movable sleeve 134 may be located adjacent to or may be forced against upper travel stops 138, which may comprise, for example, radially inwardly extending protrusions on the interior surface 128 of the housing 122, or other structures blocking further upward movement of the movable sleeve 134. In other embodiments, the movable sleeve 134 may be free to travel upwardly within the housing 122, but may not actually move upward because of gravitational forces pulling the movable sleeve 134 downward and pressure exerted on the movable sleeve 134 by fluid flowing through the actuation mechanism 114.

The movable sleeve 134 may be biased toward the first position. For example, a biasing member 140 (e.g., a coil spring, a gas spring, a tension spring, etc.) may exert a bias force on the movable sleeve 134 in a direction opposing a direction of flow of fluid through the actuation mechanism 114. More specifically, the biasing member 140 may comprise, for example, a helical coil spring supported on a ledge 141 extending radially inward from the interior surface 128 of the housing 122 and configured to exert an upward force against the movable sleeve 134 to force the movable sleeve 134 against the upper travel stops 138. A magnitude of the bias force exerted by the biasing member 140 may be configured to resist (e.g., prevent) travel of the movable sleeve 134 in the direction of flow of fluid through the actuation mechanism 114 at pressures below a triggering pressure.

The actuation mechanism 114 may include at least two selective engagement members 142 and 144 (e.g., locking dogs, ball seats, collets) configured to selectively engage with and disengage from an actuation member 118 responsive to movement of the movable sleeve 134. For example, the actuation mechanism 114 may comprise an upper selective engagement member 142 supported by the movable sleeve 134 and a lower selective engagement member 144 located farther down the flow path 132 in the direction of fluid flow through the actuation mechanism 114 also supported by the movable sleeve 134. When the movable sleeve 134 is in the first position, the upper selective engagement member 142 may be configured to engage with an actuation member 118 and the lower selective engagement member 144 may be configured to release an actuation member 118.

The actuation mechanism 114 may include an actuation member 118 (e.g., a ball, an ovoid, an obstruction, etc.). The actuation member 118 may be configured to selectively engage with and disengage from the upper and lower selective engagement members 142 and 144 and to actuate a selectively actuatable earth-boring tool 102 (see FIGS. 1 and 2) after being released from the actuation mechanism 114. When engaged with a selective engagement member 142 or 144, the actuation member 118 may not be free to flow along with fluid in the flow path 132. When disengaged from any selective engagement member 142, the actuation member 118 may be free to flow along with fluid in the flow path 132 or to fall under the influence of gravity.

The housing 122 may comprise a groove 146 formed in the interior surface 128 of the housing 122 and configured to enable the upper and lower selective engagement members 142 and 144 to selectively engage with and release the actuation member 118. The groove 146 may comprise, for example, a circular recess extending into the housing 122 and forming a circumferential depression in the interior surface 128. The groove 146 may be sized and configured to enable one of the upper and lower selective engagement members 142 or 144 to expand radially and release the actuation member 118 when a respective selective engagement member 142 or 144 is aligned with the groove 146. When one or both of the upper and lower selective engagement members 142 and 144 is misaligned from the groove 146, mechanical interference between the selective engagement members 142 and 144 and the interior surface 128 of the housing 122 may constrain (e.g., prevent) radial expansion of the selective engagement members 142 and 144 to maintain the actuation member 118 in engagement with a respective selective engagement member 142 or 144.

When the actuation mechanism 114 is in its first, initial state, the movable sleeve 134 may be in the first position. More specifically, the movable sleeve 134 may be located at a farthest displacement in a direction of the biasing force exerted in a direction opposing the direction of flow of fluid along the flow path 132 through the actuation mechanism 114. The actuation member 118 may be located in an initial, pre-actuation position wherein the actuation member 118 may be engaged with and supported by the upper selective engagement member 142. The actuation member 118 may be located in the initial, pre-actuation position before the housing 122 is connected to other components of a drill string and lowered into a borehole, which may enable an operator to use the actuation mechanism 114 without having to drop the actuation member 118 down from the surface and through components that may impede (e.g., prevent) passage of the actuation member 118 to a selectively actuatable earth-boring tool 102 (see FIGS. 1 and 2). An inner diameter 148 of the upper selective engagement member 142 may be less than a diameter 150 of the actuation member 118, which may interfere with (e.g., prevent) the actuation member 118 disengaging from the upper selective engagement member 118 to move along the flow path 132 with fluid flowing through the actuation mechanism 114. The upper selective engagement member 142 may be located in a position offset from the groove 146, which may constrain (e.g., prevent) radial expansion of the upper selective engagement member 142 and maintain the actuation member 118 engaged with the upper selective engagement member 142. The lower selective engagement member 144 may be aligned with the groove 146, enabling the lower selective engagement member 144 to expand radially into the groove 146. A fluid flowing through the actuation member 114 may exert pressure on the movable sleeve 134, actuation member 118, and upper and lower selective engagement members 142 and 144, resulting in a force acting in the direction of fluid flow that is less than a bias force exerted by the biasing member 140 in a direction opposing the direction of flow of fluid through the actuation member 114.

Figure 4:
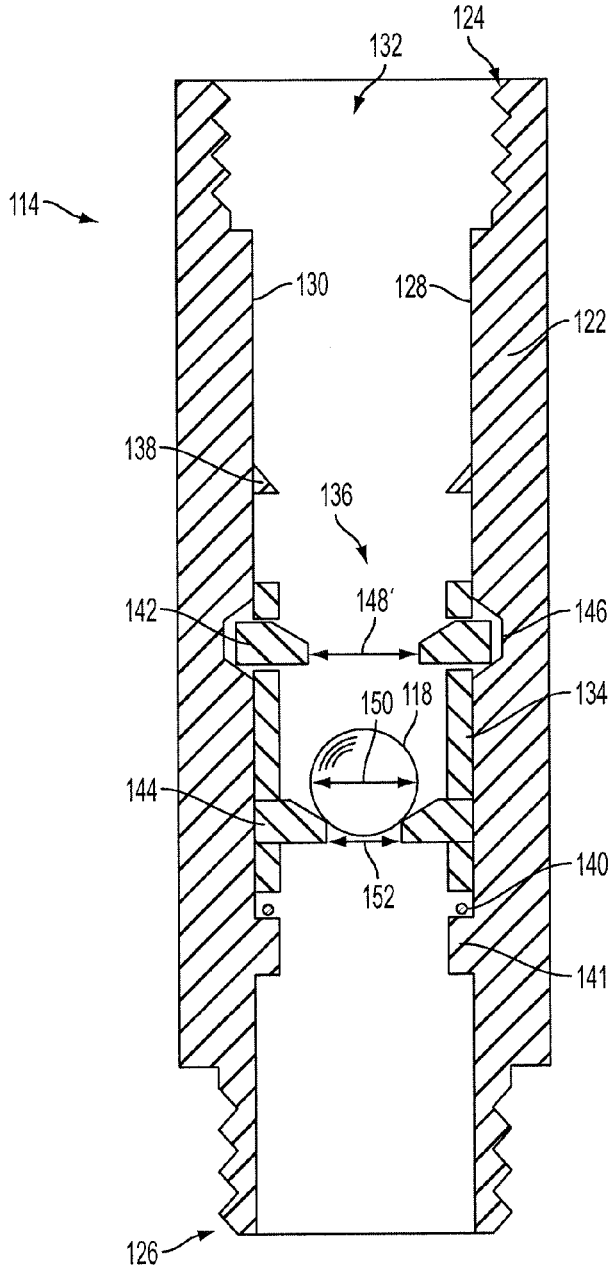
FIG. 4 is a cross-sectional view of the actuation mechanism of FIG. 3 in a second state.

Referring to FIG. 4, a cross-sectional view of the actuation mechanism 114 of FIG. 3 is shown in a second, intermediate state. The actuation mechanism 114 may transition from the first, initial state to the second, intermediate state in response to an increase in flow rate of fluid flowing through the actuation mechanism 114. For example, an operator may increase a flow rate of the fluid (e.g., from 300 gallons per minute (GPM) to 500 GPM) flowing through the actuation mechanism 114, which may result in an increase in pressure and corresponding increase in force opposing the bias force of the biasing member 140. When the force exerted on the movable sleeve 134, actuation member 118, and upper and lower selective engagement members 142 and 144 exceeds the bias force of the biasing member 140, the movable sleeve 134 may move to a second position. For example, the movable sleeve 134 may move to a lowermost extent of travel for the movable sleeve 134 in the direction of flow of fluid through the actuation mechanism 114.

When the movable sleeve 134 has moved to the second position, the upper selective engagement member 142 may align with the groove 146. Unconstrained by the interior surface 128 of the housing 122, force exerted against the actuation member 118 by the fluid flow and the cooperative interaction of the actuation member 118 with the upper selective engagement member 142 may cause the upper selective engagement member 142 to expand into the groove 146 at least until the inner diameter 148' of the upper selective engagement member 142 is greater than the diameter 150 of the actuation member 118. In response to expansion of the upper selective engagement member 142, the actuation member 118 may be released to travel along with the fluid flowing through the actuation mechanism 114. The actuation member 118 may travel downward with the fluid flow until the actuation member 118 reaches a subsequent, pre-actuation position in which it is engaged with the lower selective engagement member 144. Movement of the movable sleeve 134 to the second position may misalign the lower selective engagement member 144 from the groove 146 such that the interior surface 128 of the housing 122 interferes with (e.g., prevents) radial expansion of the lower selective engagement member 144. An inner diameter 152 of the lower selective engagement member 144 may be less than the diameter 150 of the actuation member 118, which may cause the actuation member 118 to engage with and become supported by, rather than pass through, the lower selective engagement member 144.

Figure 5:
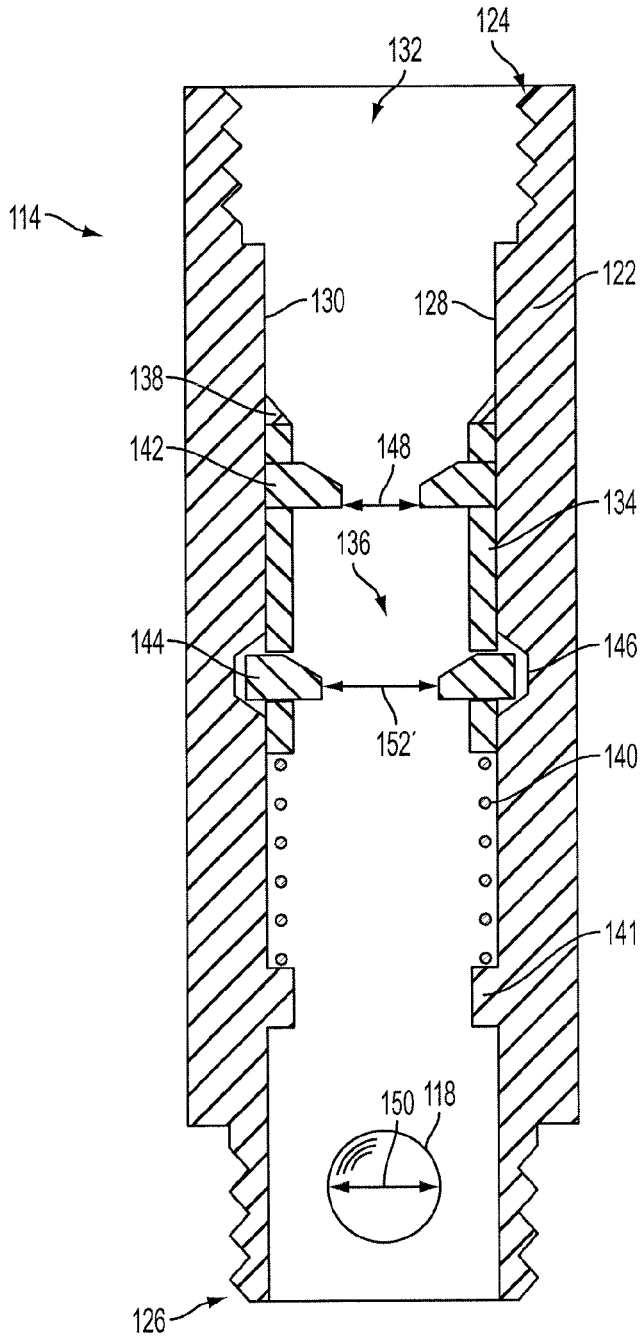
FIG. 5 is a cross-sectional view of the actuation mechanism of FIG. 3 in a third state.

Referring to FIG. 5, a cross-sectional view of the actuation mechanism 114 of FIG. 3 is shown in a third, release state. The actuation mechanism 114 may transition from the second, intermediate state to the third, release state in response to a decrease in flow rate of fluid flowing through the actuation mechanism 114. For example, an operator may decrease a flow rate of the fluid (e.g., from 500 GPM to 300 GPM or less, 150 GPM or less, or even to 0 GPM) flowing through the actuation mechanism 114, which may result in a decrease in pressure and corresponding decrease in force opposing the bias force of the biasing member 140. When the force exerted on the movable sleeve 134, actuation member 118, and upper and lower selective engagement members 142 and 144 is less than the bias force of the biasing member 140, the movable sleeve 134 may return to the first position. For example, the biasing member 140 may force the movable sleeve 134 to return to the uppermost extent of travel for the movable sleeve 134 in a direction opposing the direction of flow of fluid through the actuation mechanism 114.

When the movable sleeve 134 has returned to the first position, the lower selective engagement member 144 may realign with the groove 146. Unconstrained by the interior surface 128 of the housing 122, force exerted against the actuation member 118 by the fluid flow and the cooperative interaction of the actuation member 118 with the lower selective engagement member 144 may cause the lower selective engagement member 144 to expand into the groove 146 at least until the inner diameter 152' of the lower selective engagement member 144 is greater than the diameter 150 of the actuation member 118. In response to expansion of the lower selective engagement member 144, the actuation member 118 may be released to travel along with the fluid flowing through the actuation mechanism 114 or under the influence of gravity. The actuation member 118 may travel downward with the fluid flow or under the influence of gravity until the actuation member 118 engages with an actuating receptacle to actuate a selectively actuatable earth-boring tool 102 (see FIGS. 1 and 2). Because the actuation member 118 is released under low-flow-rate or no-flow-rate fluid flow conditions, subsequent engagement with the actuating receptacle of the selectively actuatable earth-boring tool 102 may carry a lower risk of damage to the actuation member 118, the actuating receptacle, and the selectively actuatable earth-boring tool 102. Movement of the movable sleeve 134 to the first position may misalign the upper selective engagement member 142 from the groove 146 such that the interior surface 128 of the housing 122 interferes with (e.g., prevents) radial expansion of the upper selective engagement member 142. The inner diameter 148 of the upper selective engagement member 142 may return to its original value.

Figure 6:
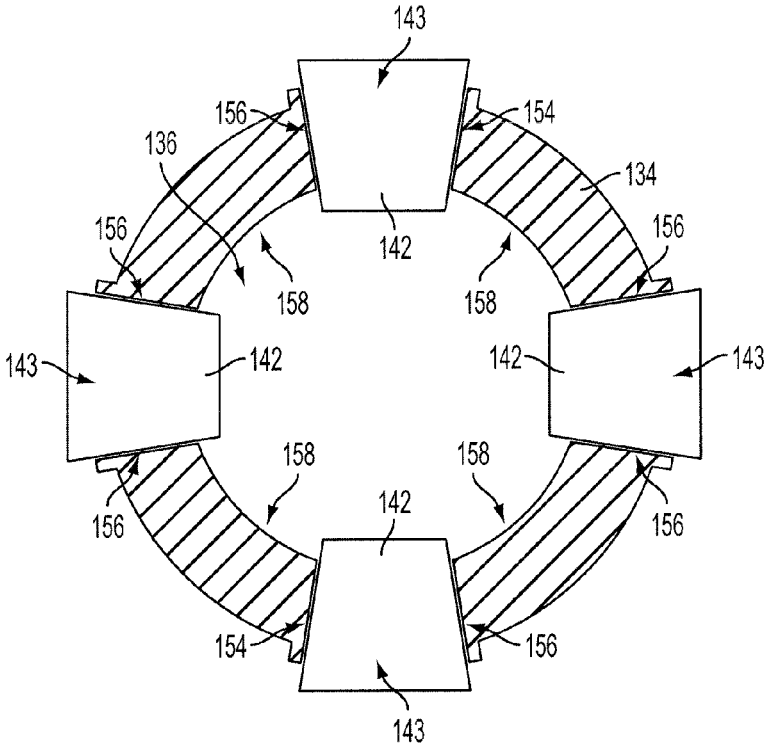
FIG. 6 is a cross-sectional view of an upper selective engagement member of the actuation mechanism of FIG. 3.

Referring to FIG. 6, a cross-sectional view of the upper selective engagement member 142 and the movable sleeve 134 of the actuation mechanism 114 of FIG. 3 is shown. In the embodiment shown in FIG. 6, the upper selective engagement member 142 may comprise a first set of locking dogs 143 intermittently located around a circumference of the movable sleeve 134 and positioned in holes 154 in the movable sleeve 134. As noted previously, the locking dogs 143 may be configured to expand radially outwardly into the groove 146 (see FIGS. 3 through 5), for example, by including an angled surface against which the actuation member 118 may be forced by the fluid flow, which may cause the locking dogs 143 to move radially outward. In addition, the locking dogs 143 may be configured not to contract radially inwardly into the central flow path 136 defined by the movable sleeve 134 such that the locking dogs 143 do not fall into the flow path 132 leading out of the actuation mechanism 114. For example, mechanical interference between the locking dogs 143 and the movable sleeve 134 may interfere with (e.g., prevent) movement of the locking dogs 143 into the central flow path 136. More specifically, each locking dog 143 may comprise a wedge-shaped (e.g., trapezoidal) cross-sectional shape and each hole 154 may include correspondingly angled surfaces 156, which may provide mechanical interference with the locking dogs 143 to constrain radial contraction of the set of locking dogs 143.

The set of locking dogs 143 may define gaps 158 between individual locking dogs 143, which may enable fluid flowing through the actuation mechanism 114 (see FIGS. 3 through 5) to flow past the set of locking dogs 143 even when an actuation member 118 is engaged with the set of locking dogs 143. For example, the set of locking dogs 143 may include two, three, four, or more individual locking dogs 143, and the individual locking dogs may be uniformly spaced or non-uniformly spaced around the circumference of the movable sleeve 134. An angular spacing of the gaps 158 between individual locking dogs 143, as measured from a center of one locking dog 143 to a center of an adjacent locking dog 143, may be about 180°, about 120°, about 90°, about 72°, about 45°, or less.

Figure 7:
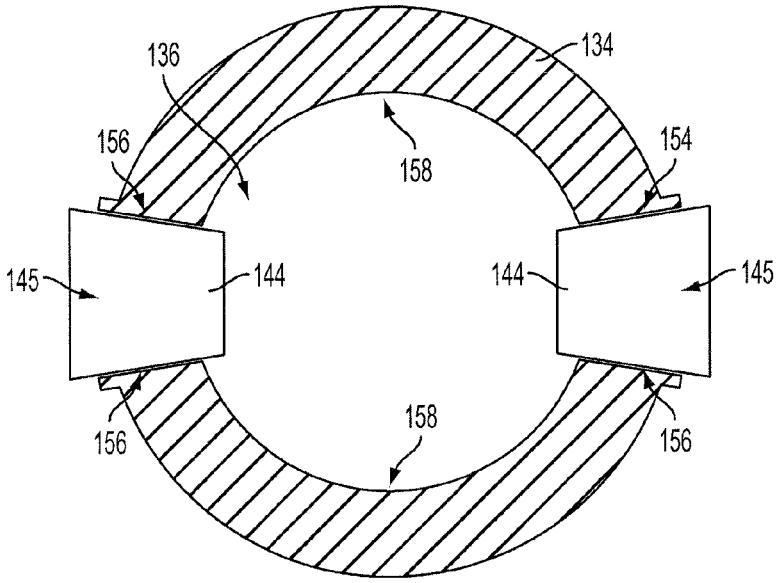
FIG. 7 is a cross-sectional view of a lower selective engagement member of the actuation mechanism of FIG. 3.

Referring to FIG. 7, a cross-sectional view of the lower selective engagement member 144 and the movable sleeve 134 of the actuation mechanism 144 of FIG. 3 is shown. The lower selective engagement member 144 may comprise a second set of locking dogs 145 similar in structure to the first set of locking dogs 143 described previously, including the optional mechanical interference interfering with (e.g., preventing) movement of the locking dogs 145 into the central flow path 136. In some embodiments, the number and size of the gaps 158 between individual locking dogs 145 of the lower selective engagement member 144 may be different from (e.g., more or less than) the number and size of gaps 158 between individual locking dogs 143 (see FIG. 6) of the upper selective engagement member 142 (see FIG. 6). By altering the size and number of the gaps 158, a pressure drop across the upper selective engagement member 142 (see FIG. 6) for a given flow rate of fluid through the actuation mechanism 114 (see FIGS. 3 through 5) may be different (e.g., more or less than) from a pressure drop across the lower selective engagement member 144 at the given flow rate, which may provide a signal to the operator whether the actuation member 118 (see FIGS. 3 through 5) has successfully been released from the upper selective engagement member 142 (see FIG. 3) to engage with the lower selective engagement member 144 (see FIG. 4).

Figure 8:
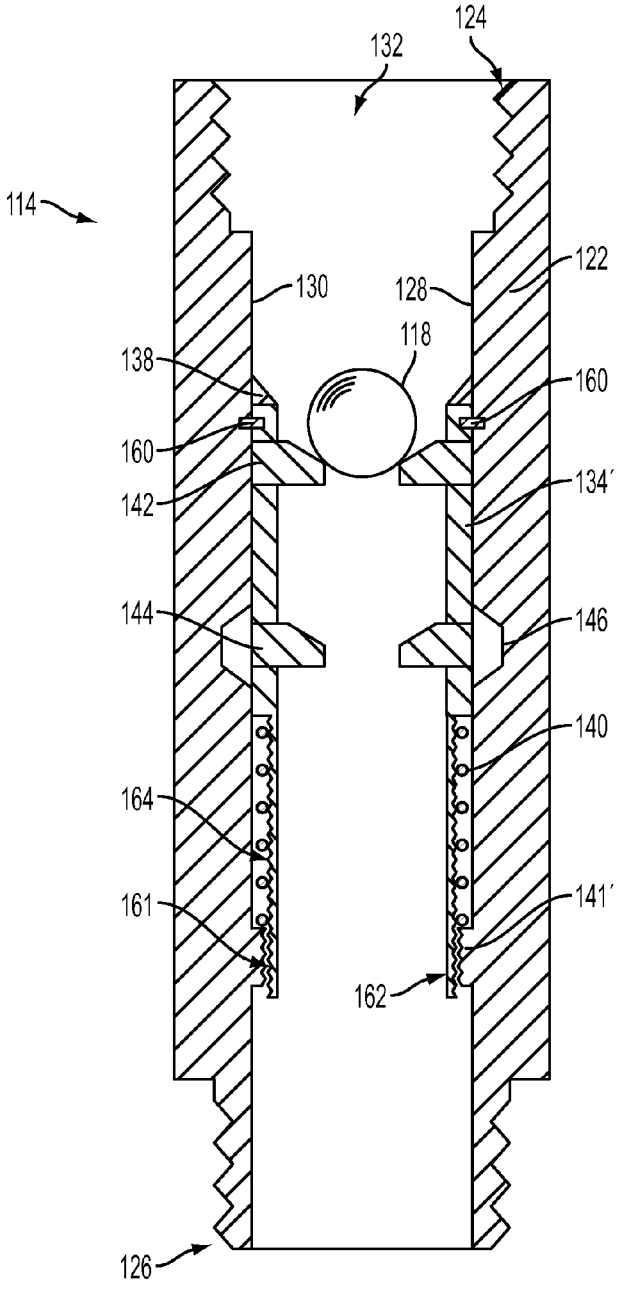
FIG. 8 is a cross-sectional view of the actuation mechanism of FIG. 3 in a first state with another embodiment of a movable sleeve.

FIG. 8 is a cross-sectional view of the actuation mechanism 114 of FIG. 3 in the first, initial state with another embodiment of a movable sleeve 134'. In some embodiments, the movable sleeve 134' may be attached to the housing 122 when the actuation mechanism 114 is in the first, initial state. For example, the movable sleeve 134' may be directly attached to the housing 122 by one or more frangible elements 160 (e.g., shear pins or shear screws). Such a configuration may enable a more predictable transition from the first, initial state to the second, intermediate state (see FIG. 4) for an operator adjusting the flow rate, and resulting pressure, of fluid flowing through the actuation mechanism 114.

In some embodiments, a portion of the movable sleeve 134' may be interposed between the biasing element 140 and the central flow path 136 of the movable sleeve 134'. For example, the movable sleeve 134' may include a skirt 162 extending in the direction of fluid flow along the flow path 132 to cover the biasing element 140. Such a configuration may increase the operating life of the biasing element 140 because the biasing element 140 is not directly exposed to flowing fluid, which may contain abrasive particles, corrosive materials, or both.

In some embodiments, the bias force of the biasing element 140 may be adjustable using, for example, an adjustable compression mechanism 161. For example, an outer surface 164 of the skirt 162 may be threaded and the ledge 141' may comprise a threaded annulus (e.g., a nut) engaged with the threads of the skirt 162. An operator may rotate the ledge 141' to raise or lower it, compressing the biasing member 140 or enabling expansion of the biasing member 140, and altering (e.g., increasing or decreasing) the bias force needed to be overcome to transition from the first, initial state to the second, intermediate state (see FIG. 4).

Figure 9:
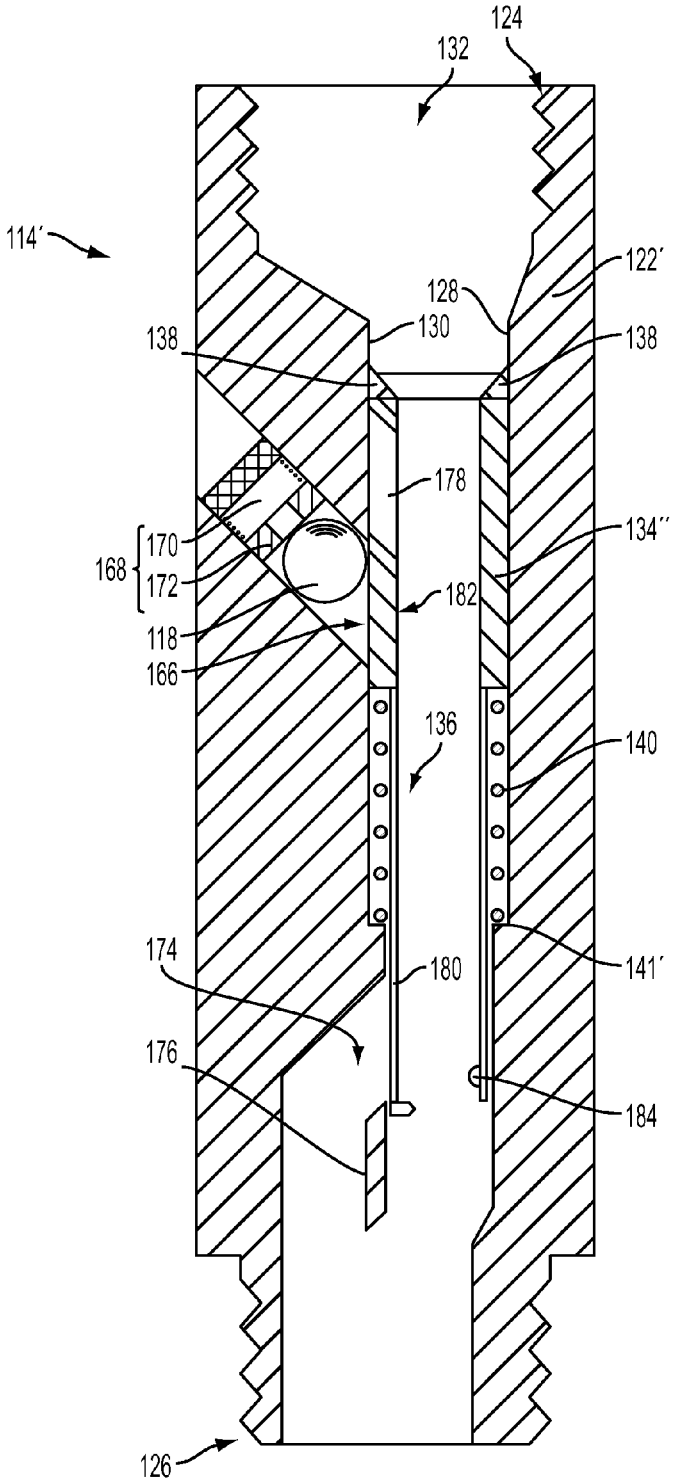
FIG. 9 is a cross-sectional view of another embodiment of an actuation mechanism in a first state.

Referring to FIG. 9, a cross-sectional view of another embodiment of an actuation mechanism 114' in a first, initial state. The actuation mechanism 114' may include a housing 122'. The housing 122' may define an outer body of the actuation mechanism 114'. Ends 124 and 126 of the housing 122' may include connections (e.g., American Petroleum Institute (API) threaded connections) to connect the housing 122' to other components of a downhole assembly 100 (see FIGS. 1 and 2). The housing 122' may comprise a tubular member having an interior surface 128 defining an internal bore 130 extending from one end 124 to the other end 126 of the housing 122'. The internal bore 130 may form a flow path 132 for fluid (e.g., drilling fluid) to flow through the actuation mechanism 114'.

The housing 122' may include an injection chamber 166 adjacent to and in communication with the flow path 132. The injection chamber 166 may be sized and configured to contain an actuation member 118 when the actuation mechanism 114' is in the first, initial state and to release the actuation member 118 into the flow path 132 when the actuation mechanism 114' is in subsequent states (see FIGS. 10 and 11). In some embodiments, an injector 168 may be located in the injection chamber 166 to exert a bias force against the actuation member 118 toward the flow path 132. For example, the injector 168 may comprise a biasing member 170 (e.g., a coil spring, a gas spring, a tension spring, etc.) configured to exert a bias force directed toward the flow path 132 and a plunger 172 configured to directly contact the actuation member 118 and impart the bias force to the actuation member 118.

The housing 122' may include a diversion path 174 forming a portion of the flow path 132. The diversion path 174 may be partially defined by an obstruction 176 in the flow path 132 and otherwise defined by the interior surface 128 of the housing 122'. The obstruction 176 may include a solid beam located in the flow path 132 and extending from one side of the interior surface 128 to the other side of the interior surface 128. At the location of the diversion path 174, the flow path 132 may be divided into two (or more) separate sections, which may converge with one another at a lower end of the diversion path 174. The diversion path 174 may be sized and configured to enable an actuation member 118 to travel around and past the obstruction 176 by entering and moving through the diversion path 174.

The actuation mechanism 114' may include a movable sleeve 134" located in the internal bore 130 and supported within the housing 122'. The movable sleeve 134" may comprise a tubular body defining a central flow path 136 for fluid to flow through the movable sleeve 134". The movable sleeve 134" may be configured to move between a first position, as shown in FIG. 9, and a second position (see FIG. 10) within the housing 122'. In the first position, the movable sleeve 134" may be located, for example, at an uppermost extent of longitudinal travel for the movable sleeve 134" in a direction opposing a direction of flow for fluid in the flow path 132 in some embodiments. More specifically, the movable sleeve 134" may be located adjacent to or may be forced against upper travel stops 138, which may comprise, for example, radially inwardly extending protrusions on the interior surface 128 of the housing 122', or other structures blocking further upward movement of the movable sleeve 134". In other embodiments, the movable sleeve 134" may be free to travel upwardly within the housing 122', but may not actually move upward because of gravitational forces pulling the movable sleeve 134" downward and pressure exerted against the movable sleeve 134" by fluid flowing through the actuation mechanism 114'. In still other embodiments, the movable sleeve 134" may be attached to the housing 122' when the actuation mechanism 114' is in the first, initial state. For example, the movable sleeve 134" may be directly attached to the housing 122 by one or more frangible elements 160 (see FIG. 8) (e.g., shear pins or shear screws). Such a configuration may enable a more predictable transition from the first, initial state to a second, intermediate state (see FIG. 10) for an operator adjusting the flow rate, and resulting pressure, of fluid flowing through the actuation mechanism 114'.

The movable sleeve 134" may be biased toward the first position. For example, a biasing member 140 (e.g., a coil spring, a gas spring, a tension spring, etc.) may exert a bias force on the movable sleeve 134" in a direction opposing a direction of flow of fluid through the actuation mechanism 114'. More specifically, the biasing member 140 may comprise, for example, a helical coil spring supported on a ledge 141' extending radially inward from the interior surface 128 of the housing 122' and configured to exert an upward force against the movable sleeve 134" to force the movable sleeve 134" against the upper travel stops 138. A magnitude of the bias force exerted by the biasing member 140 may be configured to resist (e.g., prevent) travel of the movable sleeve 134" in the direction of flow of fluid through the actuation mechanism 114' at flow rates below a triggering flow rate.

The movable sleeve 134" may include at least two ports 178 and 180 sized and configured to selectively permit an actuation member 118 to travel through a sidewall 182 of the movable sleeve 134" in response to movement of the movable sleeve 134". For example, the movable sleeve 134" may comprise an upper injection port 178 located at a first location along the movable sleeve 134" and a lower selective diversion port 180 located farther down the flow path 132 in the direction of fluid flow through the actuation mechanism 114' along the movable sleeve 134". When the movable sleeve 134" is in the first position, the upper injection port 178 may be misaligned from the injection chamber 166 such that the movable sleeve 134" obstructs the injection chamber 166 and the lower diversion port 180 may be aligned with the lower diversion path 174 such that the flow path 132 through the lower diversion port 180 to the diversion path 174 is unobstructed.

The movable sleeve 134" may include a selective engagement member 184 at a lower end of the movable sleeve 134" configured to engage with an actuation member 118 when the lower diversion port 180 is obstructed and to release the actuation member 118 in a preselected direction when the lower diversion port 180 is unobstructed. For example, the selective engagement member 184 may include protrusions extending radially inwardly from the sidewall 182 of the movable sleeve 134", with one protrusion being located at an axial position offset from an axial position of the other protrusion. When an actuation member 118 contacts the selective engagement member 184, the offset may tip the actuation member 118 toward the lower diversion port 180. When the lower diversion port 180 is obstructed, travel of the actuation member 118 through the lower diversion port 180 may be impeded (e.g., prevented) despite the actuation member 118 being tilted toward the lower diversion port 180. When the lower diversion port 180 is unobstructed, the actuation member 118 may be free to tip through the lower diversion port 180 due to the offset protrusions of the selective engagement member 184.

The actuation mechanism 114' may include an actuation member 118 (e.g., a ball, an ovoid, an obstruction, etc.). The actuation member 118 may be configured to selectively pass through the upper injection port 178 and the lower diversion port 180 and to actuate a selectively actuatable earth-boring tool 102 (see FIGS. 1 and 2) after being released from the actuation mechanism 114'. When trapped in the injection chamber 166 or engaged with the selective engagement member 184, the actuation member 118 may not be free to flow along with fluid in the flow path 132. When permitted to pass through the upper injection port 178 or the lower diversion port 180, the actuation member 118 may be free to flow along with fluid in the flow path 132 or to fall under the influence of gravity.

When the actuation mechanism 114' is in its first, initial state, the movable sleeve 134" may be in the first position. More specifically, the movable sleeve 134" may be located at a farthest displacement in a direction of the biasing force exerted in a direction opposing the direction of flow of fluid along the flow path 132 through the actuation mechanism 114'. The actuation member 118 may be located in an initial, pre-actuation position wherein the actuation member 118 may be retained in the injection chamber 166 because of the movable sleeve 134" blocking the injection chamber 166. The actuation member 118 may be located in the initial, pre-actuation position before the housing 122' is connected to other components of a drill string and lowered into a borehole, which may enable an operator to use the actuation mechanism 114' without having to drop the actuation member 118 down from the surface and through components that may impede (e.g., prevent) passage of the actuation member 118 to a selectively actuatable earth-boring tool 102 (see FIGS. 1 and 2). The upper injection port 178 may be located in a position offset from the injection chamber 166. The lower injection port 180 may be aligned with the diversion path 174 and remain unobstructed. A fluid flowing through the actuation member 114' may exert a pressure, and resulting force, on the movable sleeve 134", which force is less than a bias force exerted by the biasing member 140 in a direction opposing a direction of flow of fluid through the actuation member 114'.

Figure 10:
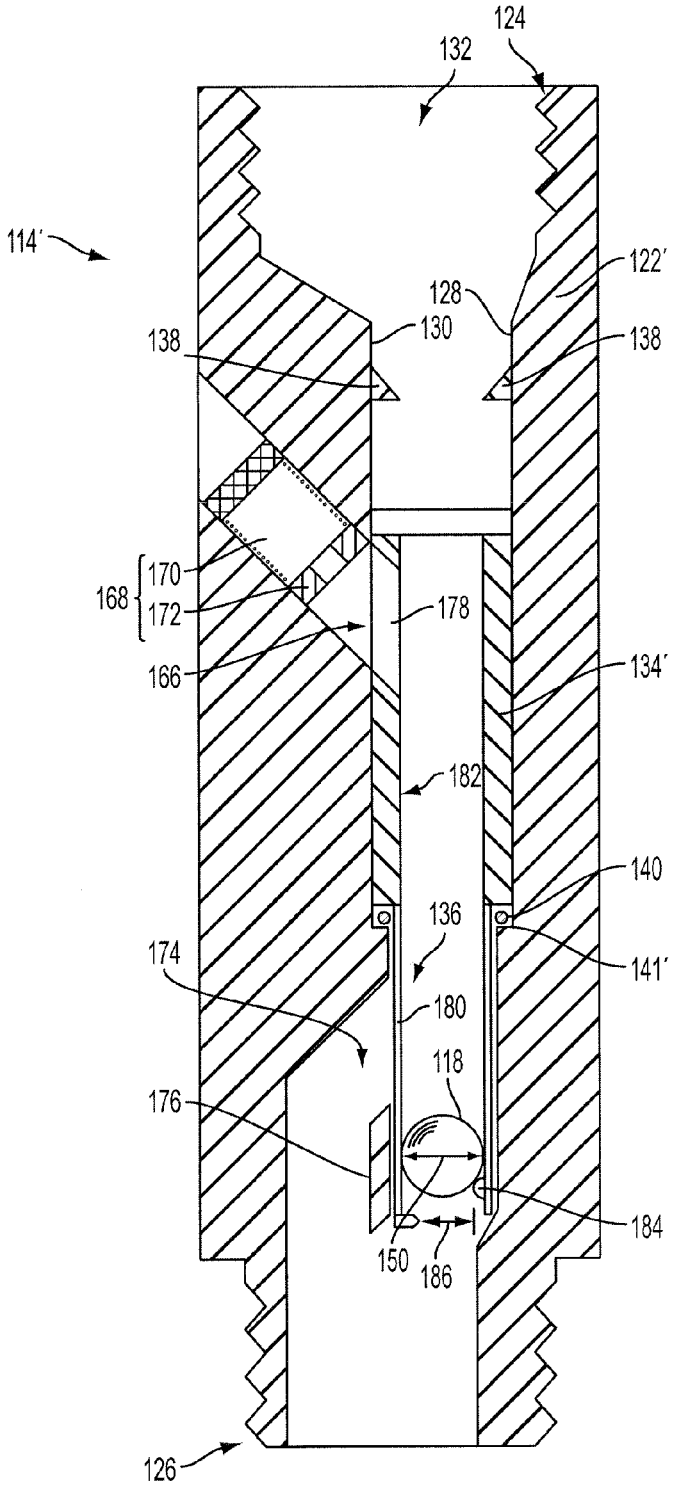
FIG. 10 is a cross-sectional view of the actuation mechanism of FIG. 9 in a second state.

Referring to FIG. 10, a cross-sectional view of the actuation mechanism 114' of FIG. 9 is shown in a second, intermediate state. The actuation mechanism 114' may transition from the first, initial state to the second, intermediate state in response to an increase in flow rate of fluid flowing through the actuation mechanism 114'. For example, an operator may increase a flow rate of the fluid (e.g., from 300 GPM to 500 GPM) flowing through the actuation mechanism 114', which may result in an increase in pressure and corresponding increase in force opposing the bias force of the biasing member 140. When the force exerted on the movable sleeve 134" exceeds the bias force of the biasing member 140, the movable sleeve 134" may move to a second position. For example, the movable sleeve 134" may move to a lowermost extent of travel for the movable sleeve 134" in the direction of flow of fluid through the actuation mechanism 114'.

When the movable sleeve 134" has moved to the second position, the upper injection port 178 may align with the injection chamber 166. Unconstrained by the interior surface movable sleeve 134", the actuation member 118 may be released into the flow path 132 to travel in the direction of fluid flow. For example, the injector 168 may force the actuation member 118 into the flow path once the path from the injection chamber 166 to the flow path 132 has been established by aligning the upper injection port 178 with the injection chamber 166. The actuation member 118 may travel downward with the fluid flow until the actuation member 118 reaches a subsequent, pre-actuation position in which it is engaged with the selective engagement member 184. Movement of the movable sleeve 134" to the second position may misalign the selective engagement member 184 from the diversion path 174 such that the obstruction 176 impedes (e.g., prevents) the actuation member 118 from passing through the lower diversion port 180. An inner diameter 186 of the selective engagement member 184 may be less than the diameter 150 of the actuation member 118, which may cause the actuation member 118 to contact and become supported by, rather than pass through, the selective engagement member 184.

Figure 11:
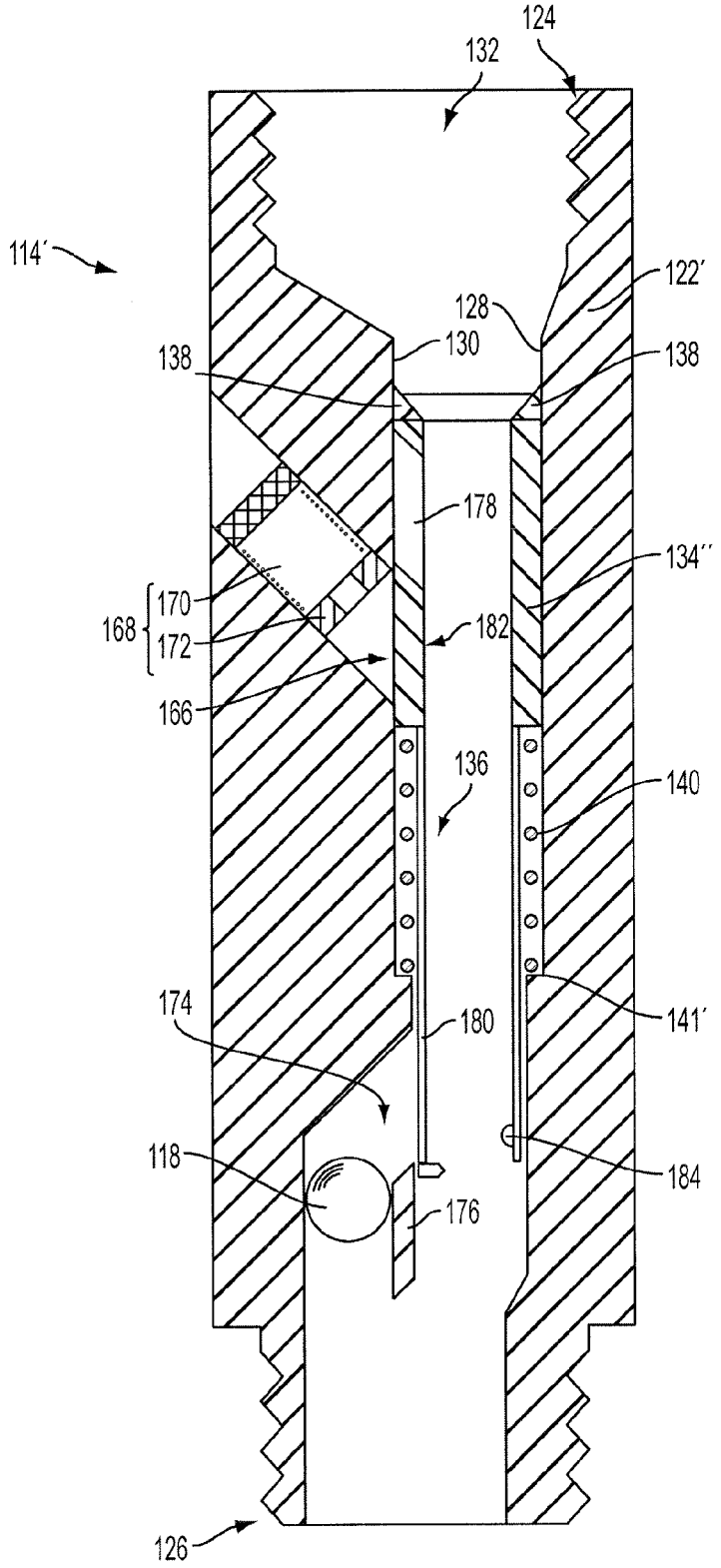
FIG. 11 is a cross-sectional view of the actuation mechanism of FIG. 9 in a third state.

Referring to FIG. 11, a cross-sectional view of the actuation mechanism 114' of FIG. 9 is shown in a third, release state. The actuation mechanism 114' may transition from the second, intermediate state to the third, release state in response to a decrease in flow rate of fluid flowing through the actuation mechanism 114'. For example, an operator may decrease a flow rate of the fluid (e.g., from 500 GPM to 300 GPM or less, 150 GPM or less, or even to 0 GPM) flowing through the actuation mechanism 114', which may result in a decrease in pressure and corresponding decrease in force opposing the bias force of the biasing member 140. When the force exerted on the movable sleeve 134" and actuation member 118 is less than the bias force of the biasing member 140, the movable sleeve 134" may return to the first position. For example, the biasing member 140 may force the movable sleeve 134" to return to the uppermost extent of travel for the movable sleeve 134" in a direction opposing the direction of flow of fluid through the actuation mechanism 114'.

When the movable sleeve 134" has returned to the first position, the lower injection port 180 may realign with the diversion path 174. No longer obstructed by the obstruction 176, the lower injection port 180 may enable the actuation member 118 to tip toward the diversion path 174 and be released to travel along with the fluid flowing through the actuation mechanism 114' or under the influence of gravity. The actuation member 118 may travel downward with the fluid flow or under the influence of gravity until the actuation member 118 engages with an actuating receptacle to actuate a selectively actuatable earth-boring tool 102 (see FIGS. 1 and 2). Because the actuation member 118 is released under low-flow-rate or no-flow-rate fluid flow conditions, subsequent engagement with the actuating receptacle of the selectively actuatable earth-boring tool 102 may carry a lower risk of damage to the actuation member 118, the actuating receptacle, and the selectively actuatable earth-boring tool 102. Movement of the movable sleeve 134" to the first position may misalign the upper injection port 178 from the injection chamber 166 such that the movable sleeve 134" obstructs the injection chamber 166.

Each of the components of the actuation mechanism 114, 114' and downhole assembly 100 described previously herein may be composed of materials suitable for use in earth-boring applications, such as, for example, metals (e.g., steel, cobalt, and alloys of such metals), ceramic-metallic composites (i.e., "cermets") (e.g., cemented tungsten carbide), and superhard materials (e.g., diamond and cubic boron nitride). Such components may be made using known manufacturing processes and equipment (e.g., by sintering, machining, casting, etc.).

Additional, non-limiting embodiments within the scope of the present disclosure include, but are not limited to:

Embodiment 1

A downhole assembly for earth-boring applications comprises a selectively actuatable earth-boring tool and an actuation mechanism located above the selectively actuatable earth-boring tool in the downhole assembly. The actuation mechanism comprises a housing comprising an internal bore defining a flow path through the housing. An actuation member is supported within the housing and is sized and configured to selectively actuate the selectively actuatable earth-boring tool. A movable sleeve is located within the internal bore and is movable between a first position and a second position responsive to changes in flow rate of fluid flowing through the flow path. The movable sleeve is biased toward the first position. The actuation member is in an initial, pre-actuation position when the movable sleeve is initially located in the first position. The actuation member is movable to a subsequent, pre-actuation position when the movable sleeve is located in the second position. The actuation member is released from the actuation mechanism when the movable sleeve is returned to the first position.

Embodiment 2

The downhole assembly of Embodiment 1, wherein: the housing comprises a groove formed in an interior surface of the housing, the interior surface defining the internal bore; the movable sleeve comprises an upper selective engagement member and a lower selective engagement member; the upper and lower selective engagement members are configured to engage with the actuation member when misaligned from the groove and to release the actuation member when aligned with the groove; the actuation member is engaged with the upper selective engagement member in the initial, pre-actuation position; the upper selective engagement member aligns with the groove when the movable sleeve is in the second position; the actuation member is engaged with the lower selective engagement member in the subsequent, pre-actuation position; and the lower selective engagement member is aligned with the groove when the movable sleeve is in the first position.

Embodiment 3

The downhole assembly of Embodiment 2, wherein the upper selective engagement member comprises a first set of locking dogs and the lower selective engagement member comprises a second set of locking dogs.

Embodiment 4

The downhole assembly of Embodiment 3, wherein a size of each gap between individual locking dogs of the first set of locking dogs is different from a size of each gap between individual locking dogs of the second set of locking dogs.

Embodiment 5

The downhole assembly of Embodiment 1, wherein: the housing comprises an injection chamber adjacent to and in communication with the flow path, a diversion path forming a portion of the flow path, and an obstruction in the flow path; the movable sleeve comprises an upper injection port and a lower diversion port extending through a sidewall of the movable sleeve and a selective engagement member adjacent the lower diversion port, the upper injection port and lower diversion port sized to enable the actuation member to pass through the upper injection port and lower diversion port, the selective engagement member sized and configured to engage with the actuation member when the lower diversion port is obstructed and to release the actuation member when the lower diversion port is unobstructed; the actuation member is located in the injection chamber in the initial, pre-actuation position; the upper injection port is aligned with the injection chamber and the lower diversion port is obstructed by the obstruction when the movable sleeve is in the second position; the actuation member is engaged with the selective engagement member in the subsequent, pre-actuation position; and the lower diversion port is aligned with the diversion path when the movable sleeve is in the first position.

Embodiment 6

The downhole assembly of Embodiment 5, further comprising an injector located in the injection chamber and configured to bias the actuation member toward the flow path when the actuation member is in the initial, pre-actuation position.

Embodiment 7

The downhole assembly of any one of Embodiments 1 through 6, wherein the movable sleeve is biased toward the first position using a spring.

Embodiment 8

The downhole assembly of Embodiment 7, wherein a portion of the movable sleeve is interposed between the spring and the flow path.

Embodiment 9

The downhole assembly of Embodiment 7 or Embodiment 8, further comprising an adjustable compression mechanism configured and located to preload the spring.

Embodiment 10

The downhole assembly of any one of Embodiments 1 through 9, further comprising at least one shear element attaching the movable sleeve to the housing when the movable sleeve is in the first position and the actuation member is in the initial, pre-actuation position.

Embodiment 11

The downhole assembly of any one of Embodiments 1 through 10, wherein the movable sleeve is configured to move to the second position in response to an increase in flow rate of fluid flowing through the flow path and is configured to return to the first position in response to a decrease in flow rate of fluid flowing through the flow path.

Embodiment 12

An actuation mechanism for downhole assemblies in earth-boring applications comprises a housing comprising an internal bore defining a flow path through the housing. An actuation member is sized and configured to be supported within the housing. A movable sleeve is located within the internal bore and is movable between a first position and a second position responsive to changes in flow rate of fluid flowing through the flow path. The movable sleeve is biased toward the first position. The actuation member is in an initial, pre-actuation position when the movable sleeve is initially located in the first position. The actuation member is movable to a subsequent, pre-actuation position when the movable sleeve is located in the second position. The actuation member is released from the actuation mechanism when the movable sleeve is returned to the first position.

Embodiment 13

A method of using an actuation mechanism for downhole assemblies in earth-boring applications comprises increasing flow rate of a fluid flowing through a flow path defined by an internal bore of a housing. A movable sleeve biased toward a first position is moved from the first position to a second position responsive to the increase in flow rate. An actuation member is released to move from an initial, pre-actuation position to a subsequent, pre-actuation position responsive to the movable sleeve being located in the second position. Flow rate of the fluid flowing through the flow path is reduced. The movable sleeve is returned to the first position responsive to the decrease in flow rate. The actuation member is released from the actuation mechanism.

Embodiment 14

The method of Embodiment 13, wherein: moving the movable sleeve to the second position comprises aligning an upper selective engagement member of the movable sleeve with a groove formed in an interior surface of the housing, the interior surface defining the internal bore; releasing the actuation member to move from the initial, pre-actuation position to the subsequent, pre-actuation position comprises releasing the actuation member from engagement with the upper selective engagement member responsive to aligning the upper selective engagement member with the groove to enable the actuation member to engage with a lower selective engagement member of the movable sleeve; returning the movable sleeve to the first position comprises enabling a biasing member engaged with the movable sleeve to move the lower selective engagement member into alignment with the groove; and releasing the actuation member from the actuation mechanism comprises releasing the actuation member from engagement with the lower selective engagement member responsive to aligning the lower selective engagement member with the groove to enable the actuation member to travel along the flow path beyond the housing.

Embodiment 15

The method of Embodiment 14, wherein releasing the actuation member from the upper selective engagement member comprises releasing the actuation member from a first set of locking dogs and releasing the actuation member from the lower selective engagement member comprises releasing the actuation member from a second set of locking dogs.

Embodiment 16

The method of Embodiment 13, wherein: moving the movable sleeve to the second position comprises aligning an upper injection port extending through a sidewall of the movable sleeve with an injection chamber adjacent to and in communication with the flow path; releasing the actuation member to move from the initial, pre-actuation position to the subsequent, pre-actuation position comprises releasing the actuation member from within the injection chamber responsive to aligning the upper injection port with the injection chamber to enable the actuation member to enter the flow path and engage with a selective engagement member of the movable sleeve, engagement with the selective engagement member being enabled by obstructing a lower diversion port of the movable sleeve with an obstruction of the housing located in the flow path; returning the movable sleeve to the first position comprises enabling a biasing member engaged with the movable sleeve to move the lower diversion port of the movable sleeve member out of obstructed alignment with the obstruction and into unobstructed alignment with a diversion path of the housing; and releasing the actuation member from the actuation mechanism comprises disengaging the actuation member from the selective engagement member, enabling the actuation member to pass through the lower diversion port, through a diversion path forming a portion of the flow path, and along the flow path beyond the housing.

Embodiment 17

The method of Embodiment 16, wherein releasing the actuation member from within the injection chamber comprises driving the actuation member toward the flow path using an injector located in the injection chamber and configured to bias the actuation member toward the flow path when the actuation member is in the initial, pre-actuation position.

Embodiment 18

The method of any one of Embodiments 13 through 17, further comprising adjusting a bias force of a spring biasing the movable sleeve toward the first position using an adjustable compression mechanism located and configured to preload the spring.

Embodiment 19

The method of any one of Embodiments 13 through 18, wherein moving the movable sleeve from the first position to the second position responsive to the increase in flow rate comprises shearing at least one shear screw attaching the movable sleeve to the housing when the movable sleeve is in the first position and the actuation member is in the initial, pre-actuation position to enable the movable sleeve to move within the housing.

Embodiment 20

The method of any one of Embodiments 13 through 19, further comprising extending blades of an earth-boring tool to engage with an earth formation responsive to release of the actuation member and engagement of the released actuation member with at least one member of the earth-boring tool.

While certain illustrative embodiments have been described in connection with the figures, those of ordinary skill in the art will recognize and appreciate that the scope of the disclosure is not limited to those embodiments explicitly shown and described herein. Rather, many additions, deletions, and modifications to the embodiments described herein may be made to produce embodiments within the scope of the disclosure, such as those hereinafter claimed, including legal equivalents. In addition, features from one disclosed embodiment may be combined with features of another disclosed embodiment while still being within the scope of the disclosure, as contemplated by the inventor.

What is claimed is:

1. A downhole assembly for earth-boring applications, comprising:

a selectively actuatable earth-boring tool; and an actuation mechanism located above the selectively actuatable earth-boring tool in the downhole assembly, the actuation mechanism comprising:

a housing comprising an internal bore defining a flow path through the housing and a groove formed in an interior surface of the housing, the interior surface defining the internal bore;

an actuation member supported within the housing and sized and configured to selectively actuate the selectively actuatable earth-boring tool; and a movable sleeve located within the internal bore and movable between a first position and a second position responsive to changes in flow rate of fluid flowing through the flow path, the movable sleeve being biased toward the first position, the movable sleeve comprising an upper selective engagement member and a lower selective engagement member, the upper and lower selective engagement members configured to engage with the actuation member when misaligned from the groove and to release the actuation member when aligned with the groove, wherein the actuation member is engaged with the upper selective engagement member when the movable sleeve is initially located in the first position, the upper selective engagement member is aligned with the groove and the actuation member is movable to engage with the lower selective engagement member when the movable sleeve is located in the second position, and the lower selective engagement member is aligned with the groove and the actuation member is released from the actuation mechanism when the movable sleeve is returned to the first position.

2. The downhole assembly of claim 1, wherein the upper selective engagement member comprises a first set of locking dogs and the lower selective engagement member comprises a second set of locking dogs.

3. The downhole assembly of claim 2, wherein a size of each gap between individual locking dogs of the first set of locking dogs is different from a size of each gap between individual locking dogs of the second set of locking dogs.

4. The downhole assembly of claim 1, wherein the movable sleeve is biased toward the first position using a spring.

5. The downhole assembly of claim 4, wherein a portion of the movable sleeve is interposed between the spring and the flow path.

6. The downhole assembly of claim 4, further comprising an adjustable compression mechanism configured and located to preload the spring.

7. The downhole assembly of claim 1, further comprising at least one shear element attaching the movable sleeve to the housing when the movable sleeve is in the first position and the actuation member is in the initial, pre-actuation position.

8. The downhole assembly of claim 1, wherein the movable sleeve is configured to move to the second position in response to an increase in flow rate of fluid flowing through the flow path and is configured to return to the first position in response to a decrease in flow rate of fluid flowing through the flow path.

9. An actuation mechanism for downhole assemblies in earth-boring applications, comprising:

a housing comprising an internal bore defining a flow path through the housing and a groove formed in an interior surface of the housing, the interior surface defining the internal bore;

an actuation member sized and configured to be supported within the housing; and a movable sleeve located within the internal bore and movable between a first position and a second position responsive to changes in flow rate of fluid flowing through the flow path, the movable sleeve being biased toward the first position, the movable sleeve comprising an upper selective engagement member and a lower selective engagement member, the upper and lower selective engagement members configured to engage with the actuation member when misaligned from the groove and to release the actuation member when aligned with the groove, wherein the actuation member is engaged with the upper selective engagement member when the movable sleeve is initially located in the first position, the upper selective engagement member is aligned with the groove and the actuation member is movable to engage with the lower selective engagement member when the movable sleeve is located in the second position, and the lower selective engagement member is aligned with the groove and the actuation member is released from the actuation mechanism when the movable sleeve is returned to the first position.

10. A method of using an actuation mechanism for downhole assemblies in earth-boring applications, comprising:

increasing flow rate of a fluid flowing through a flow path defined by an internal bore of a housing;

moving a movable sleeve biased toward a first position from the first position to a second position to align an upper selective engagement member of the movable sleeve with a groove formed in an interior surface of the housing, the interior surface defining the internal bore responsive to the increase in flow rate;

releasing an actuation member located in the actuation mechanism from engagement with the upper selective engagement member responsive to aligning the upper selective engagement member with the groove to enable the actuation member to engage with a lower selective engagement member of the movable sleeve responsive to the movable sleeve being located in the second position;

reducing flow rate of the fluid flowing through the flow path;

returning the movable sleeve to the first position by enabling a biasing member engaged with the movable sleeve to move the lower selective engagement member into alignment with the groove responsive to the decrease in flow rate; and releasing the actuation member from engagement with the lower selective engagement member responsive to aligning the lower selective engagement member with the groove to enable the actuation member to travel along the flow path beyond the housing.

11. The method of claim 10, wherein releasing the actuation member from the upper selective engagement member comprises releasing the actuation member from a first set of locking dogs and releasing the actuation member from the lower selective engagement member comprises releasing the actuation member from a second set of locking dogs.

12. The method of claim 10, wherein the biasing member comprises a spring further comprising adjusting a bias force of the spring using an adjustable compression mechanism located and configured to preload the spring.

13. The method of claim 10, wherein moving the movable sleeve from the first position to the second position responsive to the increase in flow rate comprises shearing at least one shear screw attaching the movable sleeve to the housing when the movable sleeve is in the first position and the actuation member is in the initial, pre-actuation position to enable the movable sleeve to move within the housing.

14. The method of claim 10, further comprising extending blades of an earth-boring tool to engage with an earth formation responsive to release of the actuation member and engagement of the released actuation member with at least one member of the earth-boring tool.

* * * * *